US006444930B1

(12) United States Patent
MacDonald et al.

(10) Patent No.: US 6,444,930 B1
(45) Date of Patent: Sep. 3, 2002

(54) ENVIRONMENTALLY SEALED ROCKER SWITCH

(75) Inventors: Brett A. MacDonald, Bristol; Sean H. Todd, Windsor, both of CT (US)

(73) Assignee: Carling Technologies, Plainville, CT (US)

( * ) Notice: Subject to any disclaimer, the term of this patent is extended or adjusted under 35 U.S.C. 154(b) by 0 days.

(21) Appl. No.: 09/801,296

(22) Filed: Mar. 7, 2001

(51) Int. Cl.[7] ..... H01H 21/08
(52) U.S. Cl. ..... 200/302.3
(58) Field of Search ..... 200/302.3, 302.2

(56) References Cited

U.S. PATENT DOCUMENTS

| | | | | |
|---|---|---|---|---|
| 3,115,555 A | * | 12/1963 | Lescarboura | 200/302.3 X |
| 3,248,511 A | * | 4/1966 | Heilman | 200/302.3 |
| 3,408,463 A | * | 10/1968 | Wanlass | 200/302.3 X |
| 5,105,059 A | | 4/1992 | Sorenson et al. | 200/302.3 |
| 6,011,226 A | | 1/2000 | Sadowski et al. | 200/302.3 |
| 6,013,885 A | | 1/2000 | Kowalczyk | 200/302.3 |

FOREIGN PATENT DOCUMENTS

| | | | | |
|---|---|---|---|---|
| EP | 271674 | * | 6/1988 | 200/302.2 |

* cited by examiner

*Primary Examiner*—Renee Luebke
(74) *Attorney, Agent, or Firm*—McCormick, Paulding & Huber LLP

(57) ABSTRACT

An environmentally sealed switch includes a switch housing, and a stationary contact mounted within the switch housing. A moveable contact is mounted within the switch housing. The moveable contact has a first position electrically making with the stationary contact and a second position electrically breaking with the stationary contact. An actuator is moveably mounted within the switch housing for actuating the moveable contact between the first and second positions. An internal portion of the actuator has an external neck extending through an actuator opening defined by the switch housing. A membranous boot seal surrounds the neck of the internal actuator portion. The boot seal has a first and second opening. The first opening includes a first border engaged against a periphery of the neck, and the second opening includes a second border that is retained in the switch housing and surrounds the neck of the internal actuator portion.

11 Claims, 3 Drawing Sheets

ENVIRONMENTALLY SEALED ROCKER SWITCH

FIELD OF THE INVENTION

The present invention relates generally to switches. More specifically, the present invention relates to an environmentally sealed rocker switch having a boot seal surrounding an internal actuator neck or post that supports the rocker.

BACKGROUND OF THE INVENTION

Environmentally sealed switches, e.g. toggle, pushbutton or rocker switches, are utilized in applications where environmental conditions can affect the performance or reliability of the switches. For example, switches used in mining vehicles or other off-road vehicles must be sealed against such foreign materials as mud, oil and water. Also recreational aquatic vehicles such as boats or jet skis require reliable waterproof switches.

A variety of prior art sealing mechanisms have been used to protect the switches. For example, in the case of rocker switches, prior art external boots have been used to cover the outer surface of the rocker assembly and seal against the switch housing. However, many optional features of the rocker assembly, e.g., lighting, coloring or labeling, are rendered non-functional once the switch is covered by the external boot. In another example, prior art "O" rings have been used to provide a seal between the rocker post and the actuator. Though the "O" rings provide an environmentally sound static seal, the "O" ring has a tendency to lift off of the surface of the actuator after the rocker assembly is pivoted from cyclically one position to another, thus breaking the seal.

Another approach to rocker switch sealing is shown in U.S. Pat. No. 6,011,226. An elastomeric bezel is fit tightly around a flange in the housing, and the bezel has a bead for sealingly engaging the movable rocker.

Accordingly, there is a need for an improved environmentally sealed rocker switch which will allow full function of all switch options as well as protection of the switch under both dynamic and static conditions.

SUMMARY OF THE INVENTION

In an exemplary embodiment of the invention an environmentally sealed switch includes a switch housing, and a stationary contact mounted within the switch housing. A moveable contact is mounted within the switch housing. The moveable contact has a first position for electrically making with the stationary contact and a second position for electrically breaking with the stationary contact. A rocker is provided on an internal actuator that is moveably mounted within the switch housing for moving the moveable contact between the first and second positions. The internal actuator has an external neck extending through an actuator opening defined by the switch housing. A membranous boot seal surrounds the neck of the internal actuator. The boot seal has a first opening and a second opening. The first opening includes a first border engaged against a periphery of the neck, and the second opening includes a second border engaged against a portion of the switch housing surrounding the neck of the internal actuator.

In an alternative embodiment of the invention the neck of the internal actuator of the switch has a cavity having an opening at a distal end of the neck defining a neck rim. An external actuator is mounted in fixed relation to the internal actuator, the external actuator has a stem extending into the cavity of the neck. The stem includes a stem rim congruent to the neck rim. The first border of the boot seal has a resilient first lip extending inwardly between the stem rim and neck rim to provide a dynamic seal therebetween. The dynamic seal is maintained when the external and internal actuators actuate the moveable contact from the first position to the second position.

DETAILED DESCRIPTION OF THE PREFERRED EMBODIMENTS

Figure 2:
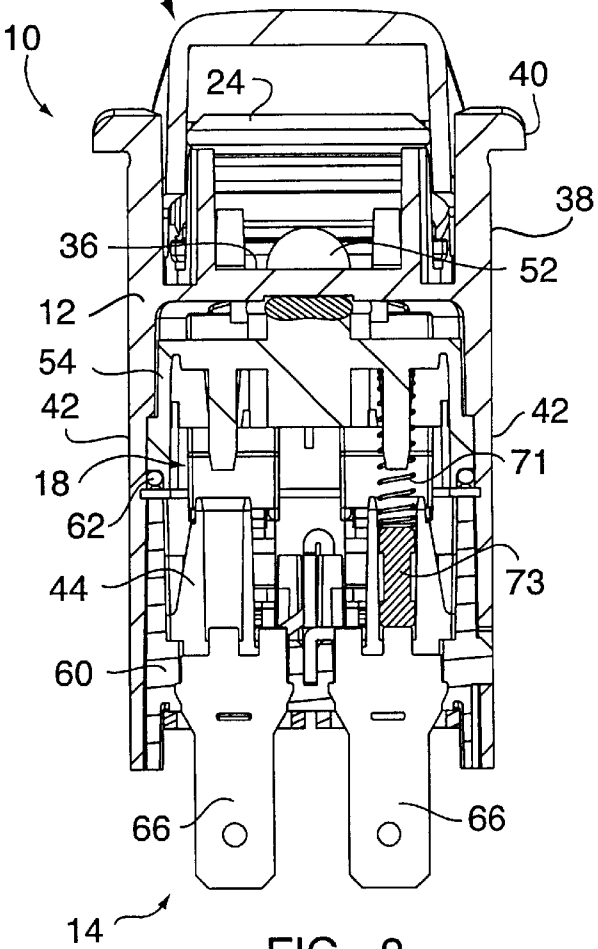
FIG. 2 is a cross sectional view along the line 2—2 of FIG. 1.
Figure 1:
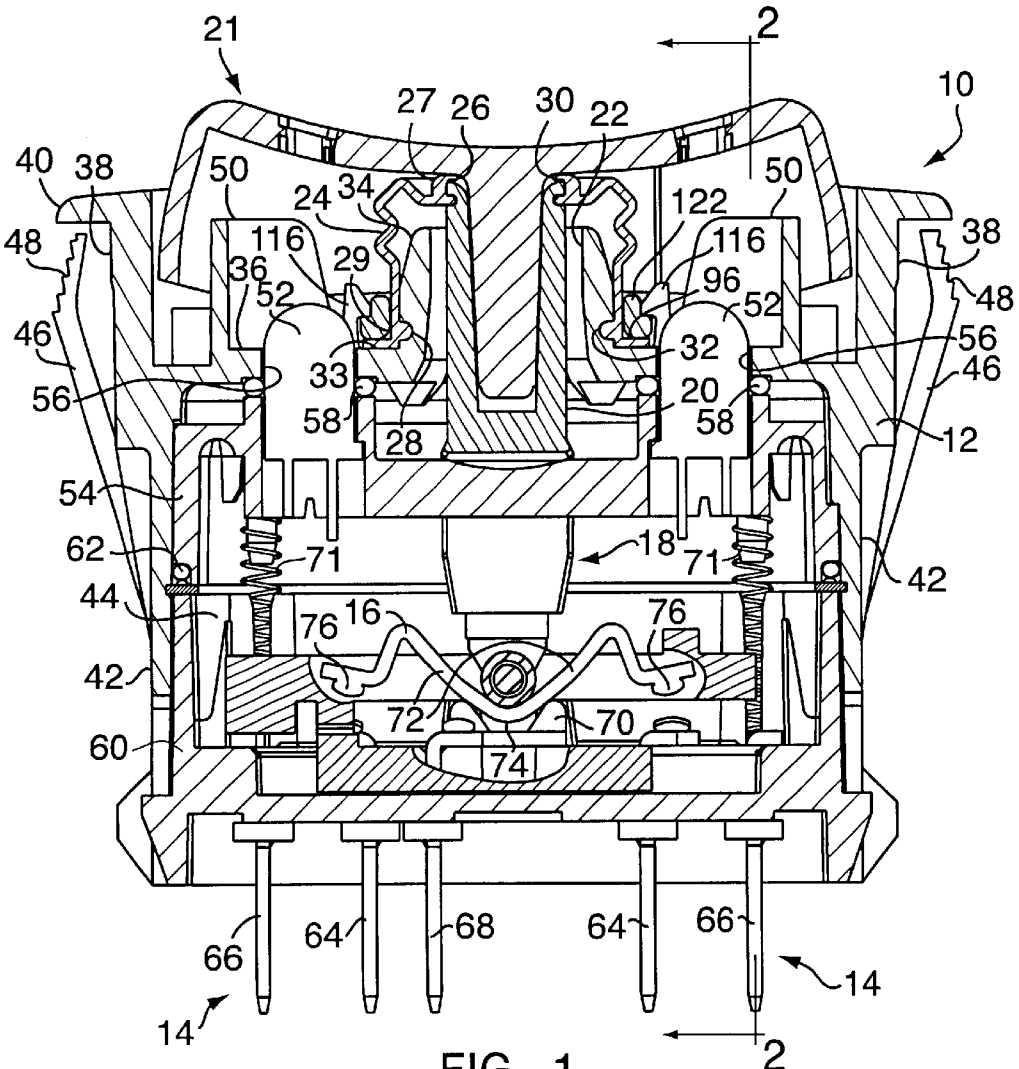
FIG. 1 is a cross sectional view along the longitudinal centerline of an exemplary embodiment of a rocker switch in accordance with the present invention.

FIGS. 1 and 2 show in sectional views an exemplary embodiment of a rocker switch 10 in accordance with the present invention. The rocker switch 10 includes a switch housing 12 for enclosing the internal components of the switch 10. At least one stationary contact 14 is mounted within the switch housing. At least one moveable contact 16 has a first make position for electrically making contact with the stationary contact 14, and a second break position for electrically breaking contact with the stationary contacts 14 the movable contact is received in a cradle defined by the center fixed terminal (fulcrum terminal) 70 for compound pivoting movement within the switch housing 12. An internal actuator 18 is pivotally mounted within the switch housing 12 for moving the moveable contact 16 between the first make position and the second break position. The internal actuator 18 has a generally cylindrical external neck 20 extending upwardly through an actuator opening 22 defined by the switch housing 12. A rocker type external actuator (rocker/actuator) 21 is mounted to the neck 20 of the internal actuator 18. This rocker/actuator 21 provides for a convenient manual operator for moving the internal actuator 18.

A membranous boot seal 24 surrounds the neck 20 of the internal actuator 18. The boot seal 24 has a first opening 26 in its upper distal end 27 and a second opening 28 in its lower distal end 29. The first opening 26 includes a first border 30 engaged against the upper periphery of the neck 20. The second opening 28 has a second border 32 engaged against a portion of the switch housing 12, i.e., a housing bushing 34, surrounding the neck 20 of the internal actuator 18. Thus, the boot seal 24 is of "hat" shape with a brim 96 and a second opening 28 that defines the border 32. The first opening 26 is defined in the top of the "hat". The bushing 34 surrounds the internal actuator 18 and the brim 96 on border 32 is held in place by a retainer ring or clip 122 received in a socket 33 defined by the switch housing top wall 36, more particularly this socket 33 is defined by resilient latch like protuberances or latches 116 integrally formed in the top wall 36. The clip 122 has an L-shaped cross section to fit into these latch-like protuberances 116.

In distinct contrast to prior art "O" ring type seals, the boot seal 24 provides a dynamic seal, which is maintained even as the internal actuator 18 is pivoted from the make position to the break position, and vice versa. Additionally, as opposed to prior art seals which cover the entire rocker/actuator 21, the boot seal also allows full function of the optional features associated with the rocker/actuator 21, i.e., color coding, lighting, or labeling options.

As used herein, and in the claims which follow, any relative terms, e.g., "upper", "lower", "longitudinal", "lateral", and their derivatives, are used with the switch in question assumed to be oriented as shown in FIG. 1. That is with the rocker/actuator 21 in the uppermost position, the stationary contacts 14 in the lowermost position, the longitudinal axis of the switch extending left to right in the plane of the paper, and the lateral axis of the switch extending transversely of the plane of the paper toward the reader.

The switch housing 12 includes a recessed top wall 36 bordered by upper wall segments 38, which surround the top wall 36. A mounting bezel 40 projects perpendicularly outwardly around the periphery of the upper distal end of the wall segment 38 to provide a means for mounting the switch 10 into a panel opening (not shown). The switch housing or bracket 12 also includes a skirt 42 extending downwardly from the border of the top wall 36 to form a downwardly opening switch cavity 44 therein. The skirt 42 of the switch housing 12 is fitted onto a base module 60 with a snap fit that holds the housing components in assembled relation. A seal 62 is trapped there between and may also provide a seal for a lamp module 54. This modular construction is referred to in a prior art U.S. Pat. No. 6,013,885 to which the reader is referred for a more complete description of the switch housing 12, and the prior art O-ring seal between the internal actuator 18 and the switch housing (bracket) 12. The bracket 12 has a pair of wings 46 extending upwardly at an acute angle from opposing longitudinal sides 42 of the bracket 12. These wings 46 have serrated upper ends 48 located proximate the bottom surface of the bezel 40. The serrated upper ends 48 of the wings 46 accommodate a variety of panel opening thicknesses when the switch 10 is mounted in a panel opening (not shown).

A pair of lamp shields 50 project vertically from opposing longitudinal end portions of the top wall 36 to provide protection for lamps 52. The lamps 52 are mounted in a lamp module 54, which is fitted into the upper portion of the switch cavity 44. Once mounted in the lamp module 54, the lamps 52 project through lamp mounting holes 56 located in the top wall 36 and are environmentally sealed against the underside of the top wall 36 via lamp "O" rings 58.

The base module 60 fits into the bracket 12 as described in the lower portion of the switch cavity 44. The base module 60 contains the movable contact 16 and the stationary contact 14 described above. Terminals 64, 66, 68, etc. are conventionally mounted in the bottom of the module 60. The terminal contacts 64 make and break directly with the moveable contact 16 as the moveable contact 16 is actuated from its make position to its break position, and vice versa. The fulcrum terminals 68 are permanently electrically connected to the moveable contact 16 through a conductive fulcrum 70. The independent contacts 66 are electrically connected to the lamps 52 through lamp springs 71, and sometimes through an optional limiting resistor 73 (best seen in FIG. 2). The independent contacts 66 provide status information on the switch 10.

The moveable contact 16 is generally M shaped (although other shapes are also possible) and includes a pair of lever portions 72 extending upwardly and longitudinally from a pivot portion 74 which is engaged against the fulcrum 68. This M-shape provides for momentary on positions for the rocker/actuate. Moveable contact terminals 76 are disposed at opposing distal ends of the moveable contact lever portions 72 to make and break directly with the stationary terminal contacts 64 when actuated by the internal actuator 18. Other movable contact shapes can be employed to achieve other functions such as stable on and off positions for the rocker/actuator.

Figure 3:
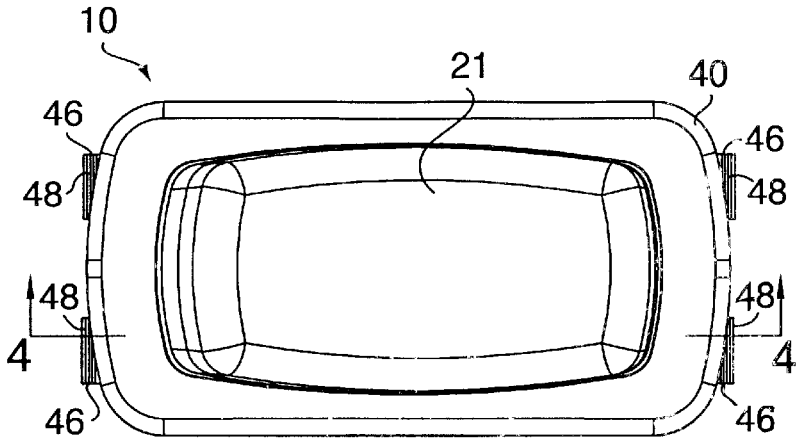
FIG. 3 is a top view of the switch of FIG. 1.
Figure 4:
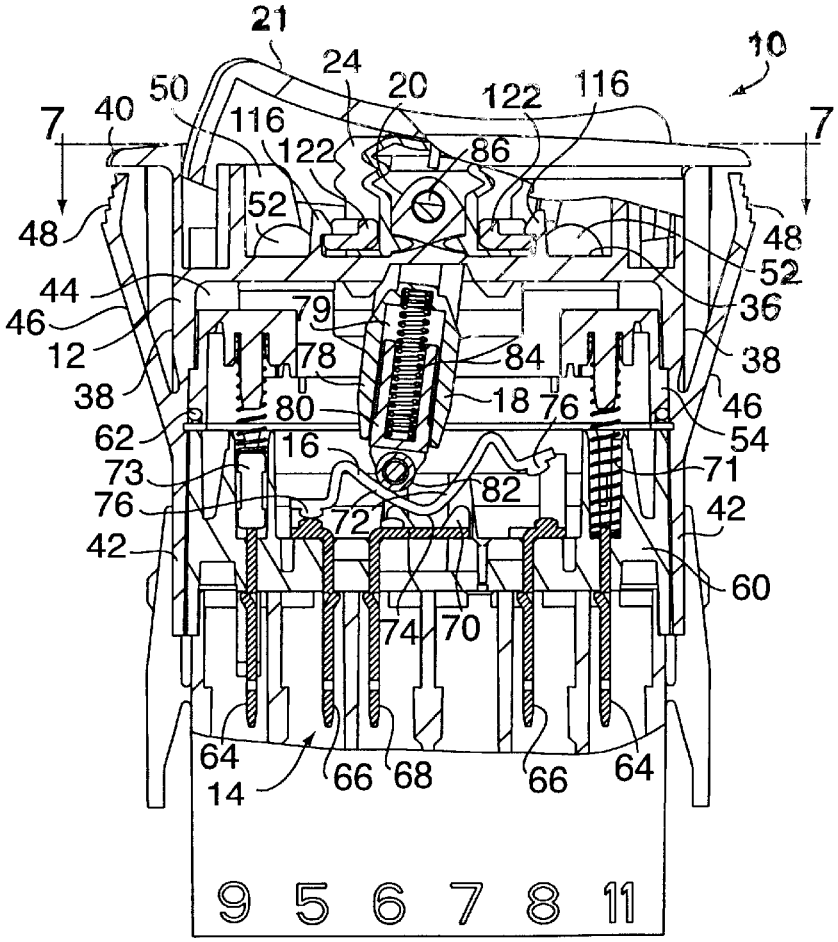
FIG. 4 is a cross sectional view taken along the line 4—4 of FIG. 3.

Referring to FIGS. 3 and 4, the internal actuator 18 includes the upwardly extending neck 20 and a pair of actuator legs 78 depending downwardly from opposing lateral ends of the internal actuator 18. The actuator legs 78 each include a downwardly opening cavity 79 sized to slidably receive a plunger 80 having a contact roller 82 disposed at its lower distal end. The roller 82 is biased against the moveable contact 16 via an actuator spring 84 disposed within the cavity 79. A pair of laterally extending tabs 86 project from the neck 20 of the internal actuator 18 through mounting holes in the sides of the housing bushing 34 to pivotally mount the internal actuator 18 therein. In operation, the switch 10 is actuated by tilting the rocker/actuator 21 to the left or right (as shown in FIG. 4) to pivot the internal actuator 18. The roller 82 of the internal actuator 18 rolls along the lever portion 72 of the moveable contact 16 to pivot the moveable contact terminals 76 into making or breaking with the stationary terminal contacts 64.

Although the embodiment described employs a rocker type external actuator 21, it will be clear to one skilled in the art that other external actuators may also be used, e.g., toggle or paddle type for example. Additionally it will be clear that the moveable contacts 16 as described may have more than a single make position or a single break position. By way of example, the present embodiment shows a moveable M shaped movable contact 16, configured for a three position switch, i.e., two make positions and a single break position. The M shape is to exert a restoring force on the actuator to provide a "momentary" switch. Other types and styles of movable and fixed contacts are possible within the scope of the present invention.

Figure 5:
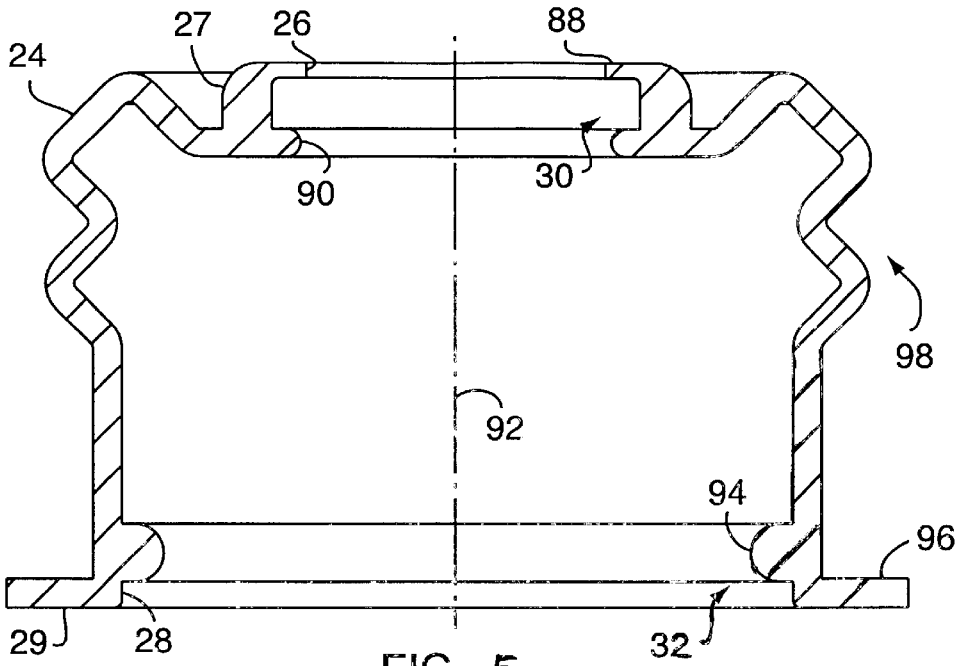
FIG. 5 is a cross sectional view along the longitudinal centerline of the boot seal of FIG. 1.

Referring to FIG. 5, the boot seal 24 is shown in detail. The first opening 26 is disposed in the upper distal end 27 of the boot seal 24. The first border 30 of the first opening 26 includes a resilient first lip 88 and a resilient second lip 90 extending radially inward toward a central axis 92 of the boot seal 24. The second opening 28 is disposed in the lower distal end 29 of the boot seal 24. The second border 32 of the second opening 28 includes a resilient third lip 94 extending radially inwardly toward the central axis 92 and the sealing brim 96 projecting radially outwardly from the outer periphery of the lower distal end 29. Additionally, the boot seal 24 includes a bellows section 98 extending around the periphery of the boot seal 24 proximate the first opening 26. The bellows section 98 allows the boot seal 24 to flex when the rocker/actuator 21 and internal actuator 18 actuate the moveable contact 16.

Figure 6:
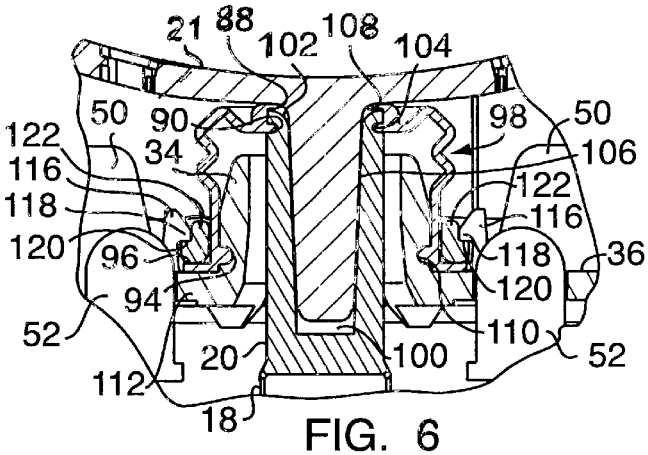
FIG. 6 is a cross sectional view of the boot seal mounted to the neck of the internal actuator of FIG. 1.
Figure 7:
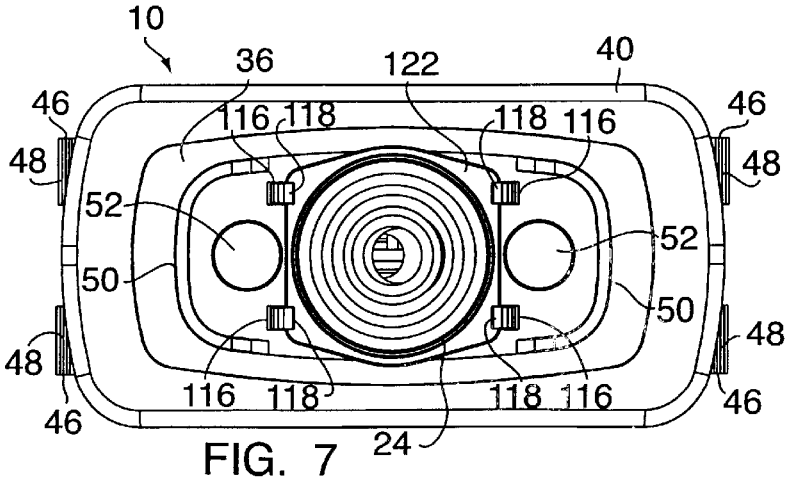
FIG. 7 is cross sectional view taken along the line 7—7 of FIG. 4.

Referring to FIGS. 6 and 7, the mounting arrangement of the boot seal 24 to the switch 10 is shown in detail. The neck 20 of the internal actuator 18 includes a neck cavity 100 having an upwardly facing opening at the upper distal end of the neck 20 defining a neck rim 102. A neck groove 104 extends around the upper periphery of the neck 20 proximate the neck rim 102. The rocker/actuator 21 has a stem 106 extending into the cavity 100 of the neck 20. The stem 106 includes a stem rim 108 congruent to the neck rim 102. The resilient first lip 88 of the boot seal 24 extends inwardly between the stem rim 108 and the neck rim 102 to provide a dynamic seal therebetween. The resilient second lip 90 of the boot seal 24 is radially compressed against the neck groove 104 to also provide a seal thereto. In operation, when the rocker/actuator 21 is tilted to actuate the internal actuator 18, the dynamic seal provided by the first lip 88 being clamped between the stem rim 108 and neck rim 102 is maintained as the first lip moves in fixed relation with the rims 102 and 108. Additionally, the bellows section 98 allows the boot seal 24 to easily flex (best seen in FIG. 5) without applying undue stress on the seals.

The housing bushing 34 of the top wall 36 extends upwardly from the switch housing 12 and includes a bushing groove 110 extending around the periphery of the lower end of the bushing. A bushing flange 112 projects radially outwardly from the outer periphery of the lower distal end of the bushing 34 and forms a portion of the top wall 36 surrounding the neck 20 of the internal actuator 18. The lower portion of the boot seal 24 slidably fits over the bushing 34 such that the third lip 94 engages the bushing groove 110 and the sealing brim 96 is flush against the top surface of the bushing flange 112. A plurality of resilient latches 116 extend upwardly from the top wall 36 between the boot seal 24 and the lamp shields 50. The upper distal end of the latches 116 include an inwardly extending hook portion 118 with a downwardly tapered top hook surface 120, which gives the latches 116 a generally L shaped cross section.

A generally ring shaped boot retainer clip 122 has an inside diameter sized to slidably fit over the boot seal and also includes a generally L shaped cross section. Upon assembly, the boot retainer clip 122 slides over the outer periphery of the boot seal 24 and engages the tapered surface 120 of the latches 116. The resilient latches 116 are flexed outward until the lower leg of the L shaped cross section of the clip 122 passes by the hook portion 118 of the latches 116. The latches 116 than flex or snap back to their original position to capture the retainer clip 122 against the boot seal 24. The pressure of the latch 116 against the boot seal 24 radially compresses the resilient third lip 94 of the boot seal 24 against the bushing groove 110 to form a seal therebetween. Additionally the latches 116 urge the sealing brim 96 of the boot seal 24 flush against the top surface of the bushing flange 112 to form another seal thereon.

While this embodiment describes the portion of the switch housing 12 surrounding the neck 20 of the internal actuator as being a housing bushing 34 and as sealing to the lower portion of the boot seal 24, other switch housing configurations may also be used to effect a seal to the boot seal 24. For example, the retainer ring 122 of FIG. 6 is circular in contour and surrounds only the boss of bushing 34. If the boot brim 96 were to extend out to surround the LEDs 56, the retainer ring might be secured to brackets around these LEDs.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An environmentally sealed switch comprising:

a switch housing;

at least one stationary contact mounted within the switch housing;

a moveable contact mounted within the switch housing, the moveable contact having a first position for electrically making with the stationary contact and a second position for electrically breaking with the stationary contact;

an actuator moveably mounted within the switch housing and having an internal actuator portion for moving the moveable contact between the first and second positions, the internal actuator portion having an external neck extending through an actuator opening defined by the switch housing, the neck of the actuator having a distal end defining a neck rim and a neck groove extending around the periphery of the neck proximate the neck rim;

a membranous boot seal surrounding the neck of the actuator portion, the boot seal having a first and second opening, the first opening being disposed adjacent the distal end of the neck and having, a resilient first lip extending inwardly over a top surface of the neck rim, and a resilient second lip radially compressed against the neck groove to provide a seal therefor, and the second opening being disposed at an opposite end of the neck and having a border engaged against a portion of the switch housing surrounding the neck; and an external actuator portion of the actuator mounted in fixed relation to the internal actuator portion, the external actuator having an external actuator rim congruent to the neck rim, the external actuator rim and neck rim compressing the resilient first lip of the boot seal therebetween to provide a dynamic seal;

wherein, the dynamic seal is maintained when the external and internal actuators actuate the moveable contact from the first position to the second position.

2. The switch of claim 1 further comprising:

the portion of the switch housing surrounding the neck of the internal actuator portion having a housing bushing extending upwardly from the housing, the housing bushing including a bushing groove extending around the periphery of the bushing; and the border of the boot seal including a resilient third lip radially compressed against the bushing groove to provide a seal therewith.

3. The switch of claim 2 wherein the border of the boot seal further comprises a sealing brim projecting radially and outwardly from an outer periphery of the lower distal end of the boot seal, and a retaining ring provided between the brim and the portion of the switch housing surrounding the neck.

4. The switch of claim 1 wherein the boot seal further includes a bellows section intermediate the first opening and the second opening, wherein the bellows section allows the boot seal to flex when the external and internal actuators actuate the moveable contact.

5. The switch of claim 1 wherein the external actuator is a rocker/actuator type actuator.

6. An environmentally sealed switch comprising:

a switch housing;

a stationary contact mounted within the switch housing;

a moveable contact mounted within the switch housing, the moveable contact having a first position for electrically making with the stationary contact and a second position for electrically breaking with the stationary contact;

an internal actuator portion moveably mounted within the switch housing for moving the moveable contact between the first and second positions, the internal actuator portion having an external neck extending through an actuator opening defined by the switch housing, the neck including a cavity having an opening at a distal end of the neck defining a neck rim and a neck groove extending around the periphery of the neck proximate the neck rim;

an external actuator portion mounted in fixed relation to the internal actuator portion, the external actuator portion having a stem extending into the cavity of the neck, the stem including a stem rim congruent to the neck rim; and a membranous boot seal surrounding the neck of the internal actuator, the boot seal having, a first opening including a first border having a resilient first lip extending inwardly between the stem rim and neck rim to provide a dynamic seal and a resilient second lip radially compressed against the neck groove to provide a seal thereto, and a second opening including a second border engaged against a portion of the switch housing surrounding the neck of the internal actuator;

wherein, the dynamic seal is maintained when moveable contact is moved between the first position and the second position.

7. The switch of claim 6 further comprising:

the portion of the switch housing surrounding the neck of the internal actuator portion having a housing bushing extending upwardly from the housing, the housing bushing including a bushing groove extending around the periphery of the bushing; and the second border of the boot seal including a resilient third lip radially compressed against the bushing groove and a sealing brim projecting radially outward from an outer periphery of a lower distal end of the boot seal.

8. The switch of claim 7 wherein the boot seal further includes a bellows section intermediate said first opening and said second opening, wherein the bellows section allows the boot seal to flex when the actuator moves the moveable contact.

9. A boot seal for environmentally sealing a rocker switch, the boot seal comprising:

a first opening disposed in an upper end of the boot seal, the first opening having a first boarder which includes resilient first and second lips extending generally parallel and radially inward toward a central axis of the boot seal; and a second opening disposed in a lower end of the boot seal, the second opening having a second boarder which includes a sealing brim projecting radially outwardly from the central axis and a third lip projecting radially inwardly toward the central axis of the boot seal.

10. The boot seal of claim 9 further comprising a bellows section intermediate the first opening and the second opening.

11. An environmentally sealed switch comprising:

a switch housing;

at least one stationary contact mounted within the switch housing;

a moveable contact mounted within the switch housing, the moveable contact having a first position for electrically making with the stationary contact and a second position for electrically breaking with the stationary contact;

an actuator moveably mounted within the switch housing and having an internal actuator portion for moving the moveable contact between the first and second positions, the internal actuator portion having an external neck extending through an actuator opening defined by the switch housing, the neck including a cavity having an opening at a distal end of the neck defining a neck rim;

a membranous boot seal surrounding the neck of the actuator portion, the boot seal having a first and second opening, the first opening being disposed adjacent the distal end of the neck and having a resilient lip extending inwardly over a top surface of the neck rim, and the second opening being disposed at an opposite end of the neck and having a border engaged against a portion of the switch housing surrounding the neck; and an external actuator portion of the actuator mounted in fixed relation to the internal actuator portion, the external actuator portion having a stem extending into the cavity of the neck and a stem base with an external actuator rim disposed thereon such that the external actuator rim is congruent to the neck rim, the external actuator rim and neck rim compressing the resilient lip of the boot seal therebetween to provide a dynamic seal;

wherein, the dynamic seal is maintained when the external and internal actuators actuate the moveable contact from the first position to the second position.

* * * * *